US011903421B2

(12) United States Patent
Liu

(10) Patent No.: US 11,903,421 B2
(45) Date of Patent: Feb. 20, 2024

(54) HIGH-FREQUENCY HEATING DEVICE

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 454 days.

(21) Appl. No.: 17/165,985

(22) Filed: Feb. 3, 2021

(65) Prior Publication Data

US 2022/0160039 A1 May 26, 2022

(30) Foreign Application Priority Data

Nov. 26, 2020 (CN) ..... 202022773026.3

(51) Int. Cl.

| | |
|---|---|
| ***A24F 47/00*** | (2020.01) |
| ***A24F 40/465*** | (2020.01) |
| ***A24F 1/30*** | (2006.01) |
| *A24F 40/20* | (2020.01) |

(52) U.S. Cl.
CPC ..... *A24F 40/465* (2020.01); *A24F 1/30* (2013.01); *A24F 40/20* (2020.01)

(58) Field of Classification Search
CPC ..... A24F 40/465; A24F 1/30
See application file for complete search history.

(56) References Cited

U.S. PATENT DOCUMENTS

2022/0010501 A1* 1/2022 Fulham-Lebrasseur ..... H05B 3/286

FOREIGN PATENT DOCUMENTS

| | | | | |
|---|---|---|---|---|
| CA | 2992893 A1 * | 7/2019 | ..... | A24B 15/16 |
| EP | 3560674 A1 * | 10/2019 | ..... | B29C 45/14065 |
| WO | WO-2020118663 A1 * | 6/2020 | | |

OTHER PUBLICATIONS

Xu Baoan, Adjustable Vacuum Heat Insulation Glass Plate Provided With Metal Brazed Sandwich Rolling Supported By Protective Frame—English Translation, Jun. 8, 2023, European Patent Office (Year: 2023).*

* cited by examiner

*Primary Examiner* — Eric Yaary
(74) *Attorney, Agent, or Firm* — MATTHIAS SCHOLL P.C.; Matthias Scholl

(57) ABSTRACT

A high-frequency heating device includes a housing, a thermal insulation sleeve and a magnetic induction coil. The housing includes a central through hole and an enclosure surrounding the central through hole. The enclosure includes a cavity and the magnetic induction coil is disposed in the cavity. The thermal insulation sleeve is fixed in the magnetic induction coil. When in use, the neck of a hookah passes through the central through hole, and a heating cup containing tobacco material is disposed around the neck. The enclosure is disposed around the heating cup so that the high-frequency heating device is able to heat the tobacco material in the heating cup.

8 Claims, 5 Drawing Sheets

HIGH-FREQUENCY HEATING DEVICE

CROSS-REFERENCE TO RELAYED APPLICATIONS

Pursuant to 35 U.S.C. § 119 and the Paris Convention Treaty, this application claims foreign priority to Chinese Patent Application No. 202022773026.3 filed on Nov. 26, 2020, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to a high-frequency heating device.

Conventionally, the high-frequency heating device is integrated with the hookah, which leads to the difficulty for cleaning the heating device. Or, the high-frequency heating device is detachably connected to the hookah, when in use, the high-frequency heating device needs to be held by hand.

SUMMARY

The disclosure provides a high-frequency heating device, comprising a housing, a thermal insulation sleeve and a magnetic induction coil; the housing comprises a central through hole and an enclosure surrounding the central through hole; the enclosure comprises a cavity and the magnetic induction coil is disposed in the cavity; the thermal insulation sleeve is fixed in the magnetic induction coil; when in use, a neck of a hookah passes through the central through hole, and a heating cup containing tobacco material is disposed around the neck; the enclosure is disposed around the heating cup so that the high-frequency heating device is able to heat the tobacco material in the heating cup.

In a class of this embodiment, the high-frequency heating device further comprises a variable-frequency power supply and a battery; the variable-frequency power supply and the battery are disposed in the housing; an output end of the battery is soldered on an input end of the variable-frequency power supply for power supply; an output end of the variable-frequency power supply is soldered on the magnetic induction coil; in a power on state, an alternating current output by the variable-frequency power supply flows through the magnetic induction coil whereby an induced magnetic field is produced.

In a class of this embodiment, the high-frequency heating device further comprises a temperature difference sensor; the temperature difference sensor is soldered on the variable-frequency power supply and is disposed in an opening of the thermal insulation sleeve to sense a temperature change of an air flow, so as to control the variable-frequency power supply whether or not to enter an automatic heating working mode.

In a class of this embodiment, the high-frequency heating device further comprises a thermistor, wherein the thermistor is soldered on the variable-frequency power supply and is located in an inner wall of the thermal insulation sleeve for over temperature protection; when a working temperature reaches a maximum of 600° F., no current is output from the variable-frequency power supply, and the high-frequency heating device stops working.

In a class of this embodiment, the high-frequency heating device further comprises a sliding button and a manual button, wherein the manual button is connected to a second contact terminal on the variable-frequency power supply to switch on the power supply to heat the tobacco material; the sliding button is connected to a third contact terminal on the variable-frequency power supply and is exposed out from a side wall of the housing; when in use, the working mode of the high-frequency heating device is switchable by pressing the sliding button so as to heat different tobacco materials.

In a class of this embodiment, when the high-frequency heating device is in use with the heating cup and the hookah, the heating cup is disposed around the neck of the hookah; a diameter of the heating cup is corresponding to that of the central through hole of the housing, so that the thermal insulation sleeve is disposed around the heading cup.

In a class of this embodiment, the heating cup comprises glass and a metal inlaid in the glass, and has a frosted surface.

In a class of this embodiment, the hookah further comprises a nozzle disposed on a top of the heating cup for air admission.

In a class of this embodiment, in a power on state, the heating cup is heated in an induction magnetic field formed by the magnetic induction coil, so that the tobacco material in the heating cup is heated to produce vapor or smoke; air enters the heating cup via the nozzle, and an internal temperature in the heating cup varies; the temperature difference sensor senses a change of temperature in the air flow and controls the variable-frequency power supply to work in an automatic heating mode; the air drives the vapor or smoke in the heating cup to submerge in the water in the hookah, and the vapor or smoke is filtered in the water and discharged out of an exit for user's inhaling.

DETAILED DESCRIPTION

Figure 1:
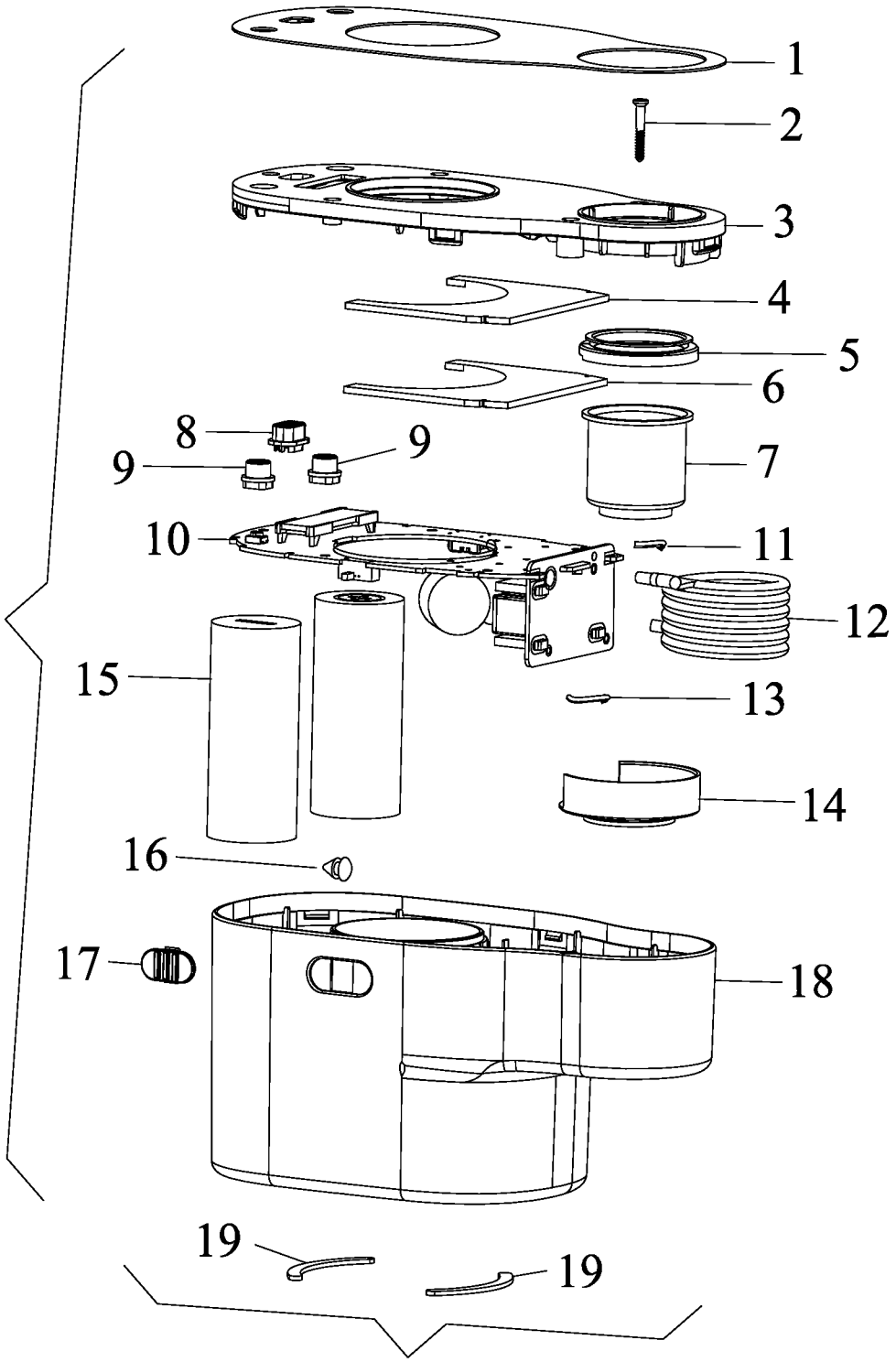
FIG. 1 is an exploded view of a high-frequency heating device in accordance with one embodiment of the disclosure.
Figure 2:
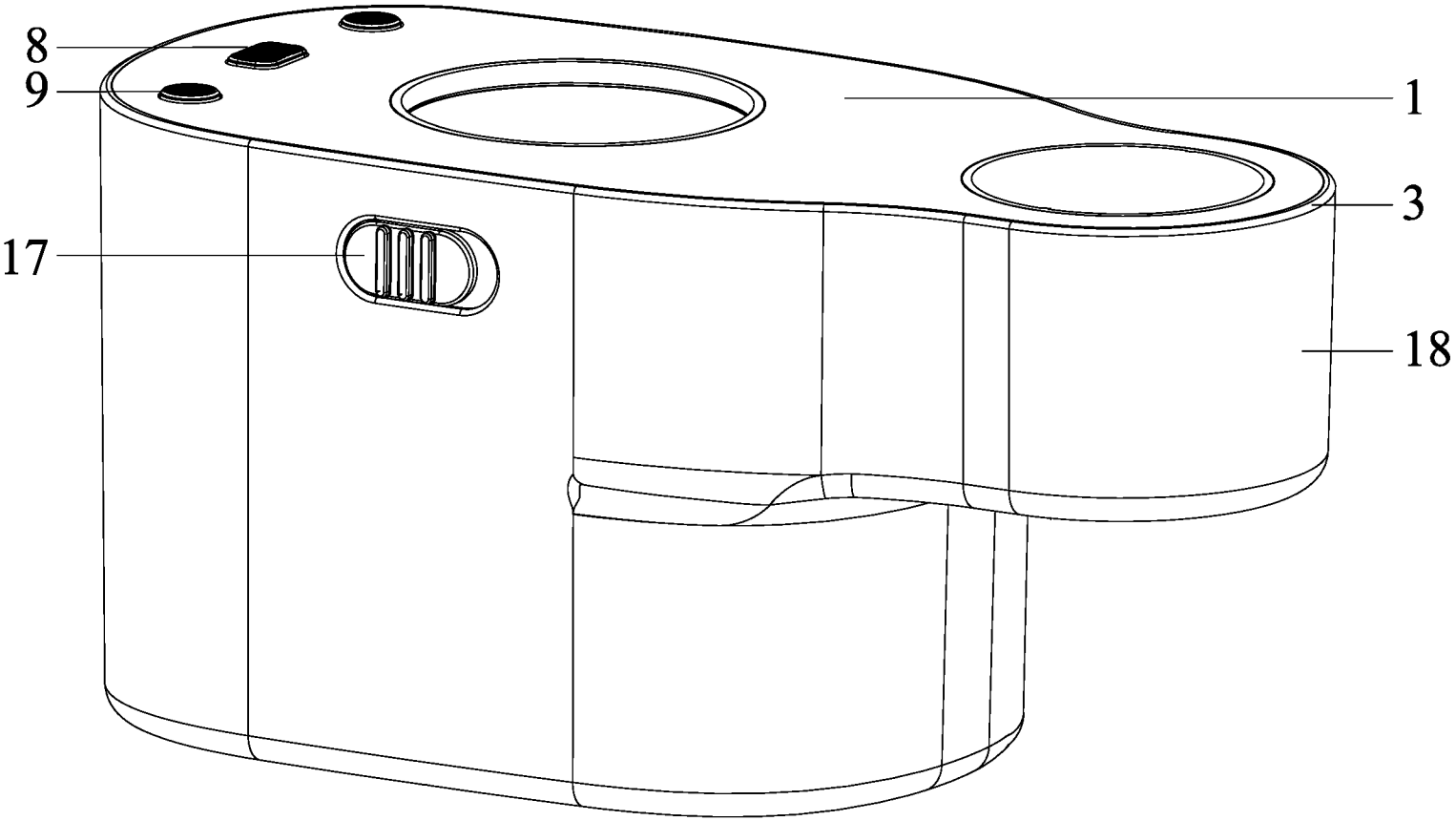
FIG. 2 is a schematic diagram of a high-frequency heating device in accordance with one embodiment of the disclosure.
Figure 3:
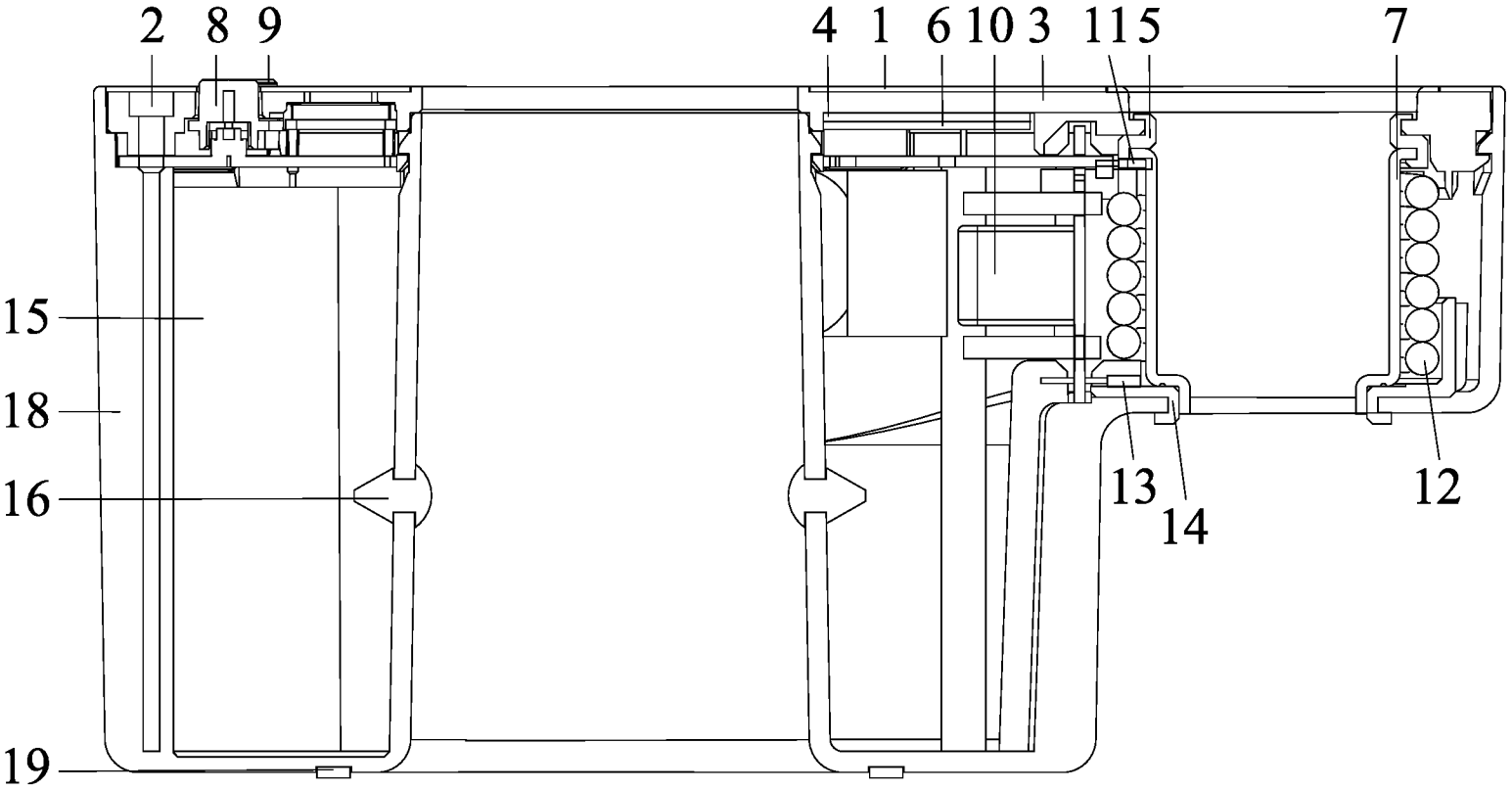
FIG. 3 is a sectional view of a high-frequency heating device in accordance with one embodiment of the disclosure.

To further illustrate, embodiments detailing a high-frequency heating device are described below. It should be noted that the following embodiments are intended to describe and not to limit the disclosure.

Principle of microwave heating: microwave heating is a multiphysics phenomenon that involves electromagnetic waves and heat transfer; any material that is exposed to electromagnetic radiation will be heated up owing to the collision between the material molecules. The rapidly varying electric and magnetic fields lead to sources of heating.

Tobacco materials refer to tobacco tar, tobacco paste, tobacco leaf and other materials used to produce smoke.

As shown in FIGS. 1-5, the disclosure provides a high-frequency heating device comprises an end cover 1, a screw 2, an upper cover 3, a radiating fin 4, a thermal insulation ring 5, a silicone thermal conductor 6, a thermal insulation sleeve 7, a manual button 8, a power regulation button 9, a variable-frequency power supply 10, a temperature difference sensor 11, a magnetic induction coil 12, a thermistor 13, a positioning sleeve 14, a battery 15, a silicone plug 16, a sliding button 17, a housing 18, and a silicone gasket 19. The housing 18 comprises a central through hole and an enclosure surrounding the central through hole. The enclosure comprises a cavity and the magnetic induction coil 12 is disposed in the cavity. The thermal insulation sleeve 7 is fixed in the magnetic induction coil 12. The thermal insulation ring 5 and the positioning sleeve 14 are disposed on two ends of the thermal insulation sleeve 7, respectively, for thermal insulation and location. The radiating fin 4 and the silicone thermal conductor 6 are attached to the surface of the variable-frequency power supply 10 for heat dissipation. The variable-frequency power supply 10 and the battery 15 are fixed in the housing 18. The output end of the battery 15 is soldered on the input end of the variable-frequency power supply 10 for power supply; the output end of the variable-frequency power supply 10 is soldered on the magnetic induction coil 12. In the power on state, the alternating current output by the variable-frequency power supply flows through the magnetic induction coil 12, and thus an induced magnetic field is produced. The temperature difference sensor 11 is soldered on the variable-frequency power supply 10 and is disposed in the opening of the thermal insulation sleeve 7 to sense the temperature change of the airflow, so as to control the variable-frequency power supply 10 whether or not to enter the automatic heating working mode. The thermistor 13 is soldered on the variable-frequency power supply 10 and is located in the inner wall of the thermal insulation sleeve 7 for over temperature protection. When the working temperature reaches the maximum of 600° F., no current is output from the variable-frequency power supply 10, and the heating device stops working. The power regulation button 9 is connected to a first contact terminal on the variable-frequency power supply 10 to adjust the output power of the power supply. The manual button 8 is connected to a second contact terminal on the variable-frequency power supply 10 to switch on the power supply to heat the tobacco material. The sliding button 17 is connected to a third contact terminal on the variable-frequency power supply 10 and is exposed out from the side wall of the housing 18. Pressing the sliding button can switch the working mode of the heating device to heat different tobacco materials. The silicone plug 16 is fixed in the through hole in the middle part of the housing 18. When the heating device of the disclosure is in use with a hookah 22, the silicone plug is attached to the neck of the hookah 22 to prevent the heating device from shaking. The upper cover 3 is fixed on the top of the housing 18 via the screw 2. The manual button 8 and the power regulation button 9 are at least partially exposed out of the surface of the upper cover 3. The end cover 1 is disposed on the surface of the upper cover 3. The battery 15 is fixed on the inner bottom surface of the housing 18. The silicone gasket 19 is disposed on the outer bottom surface of the housing 18 to reduce the friction between the housing 18 and the hookah 22.

Figure 4:
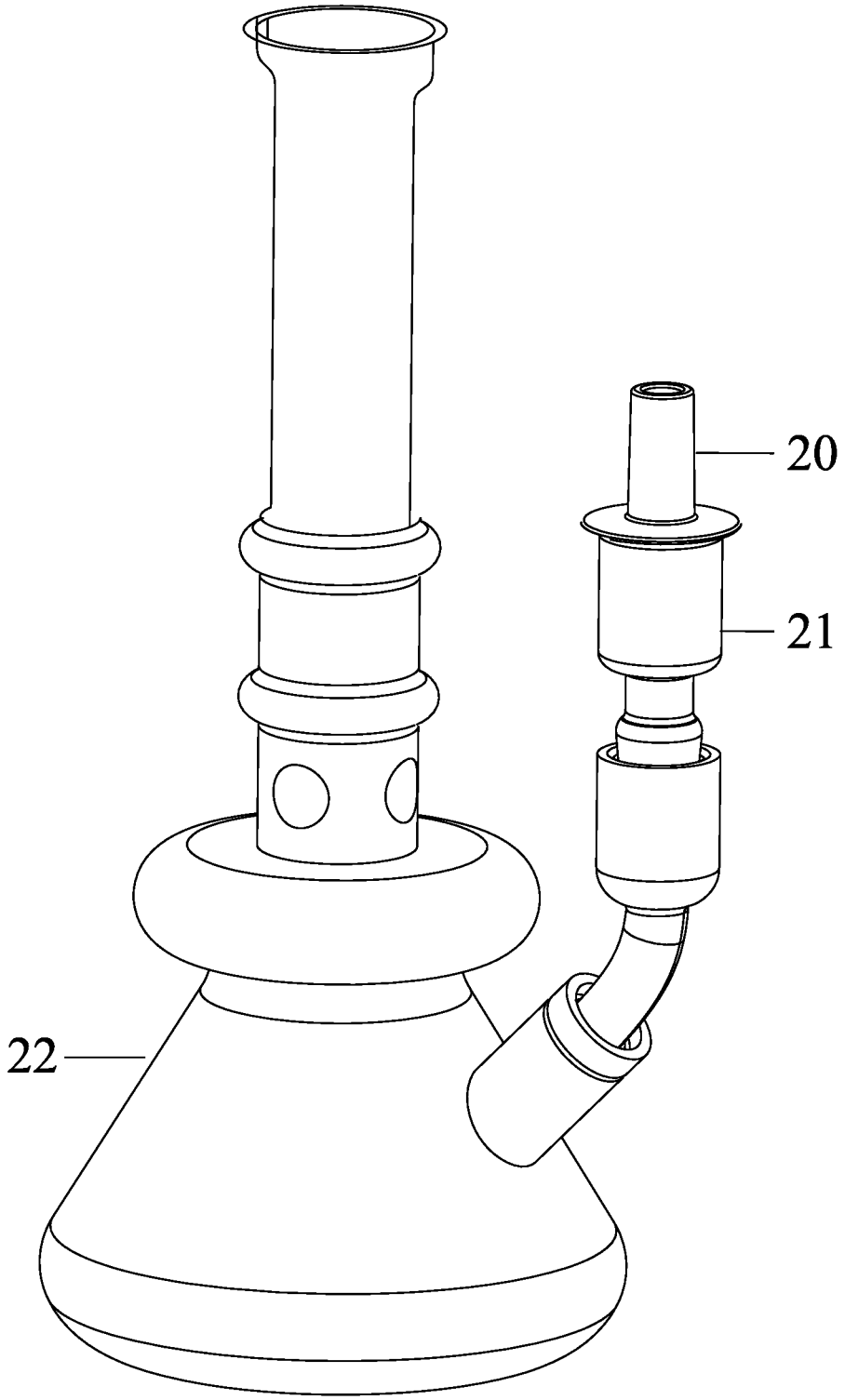
FIG. 4 is a schematic diagram of a hookah in accordance with one embodiment of the disclosure.
Figure 5:
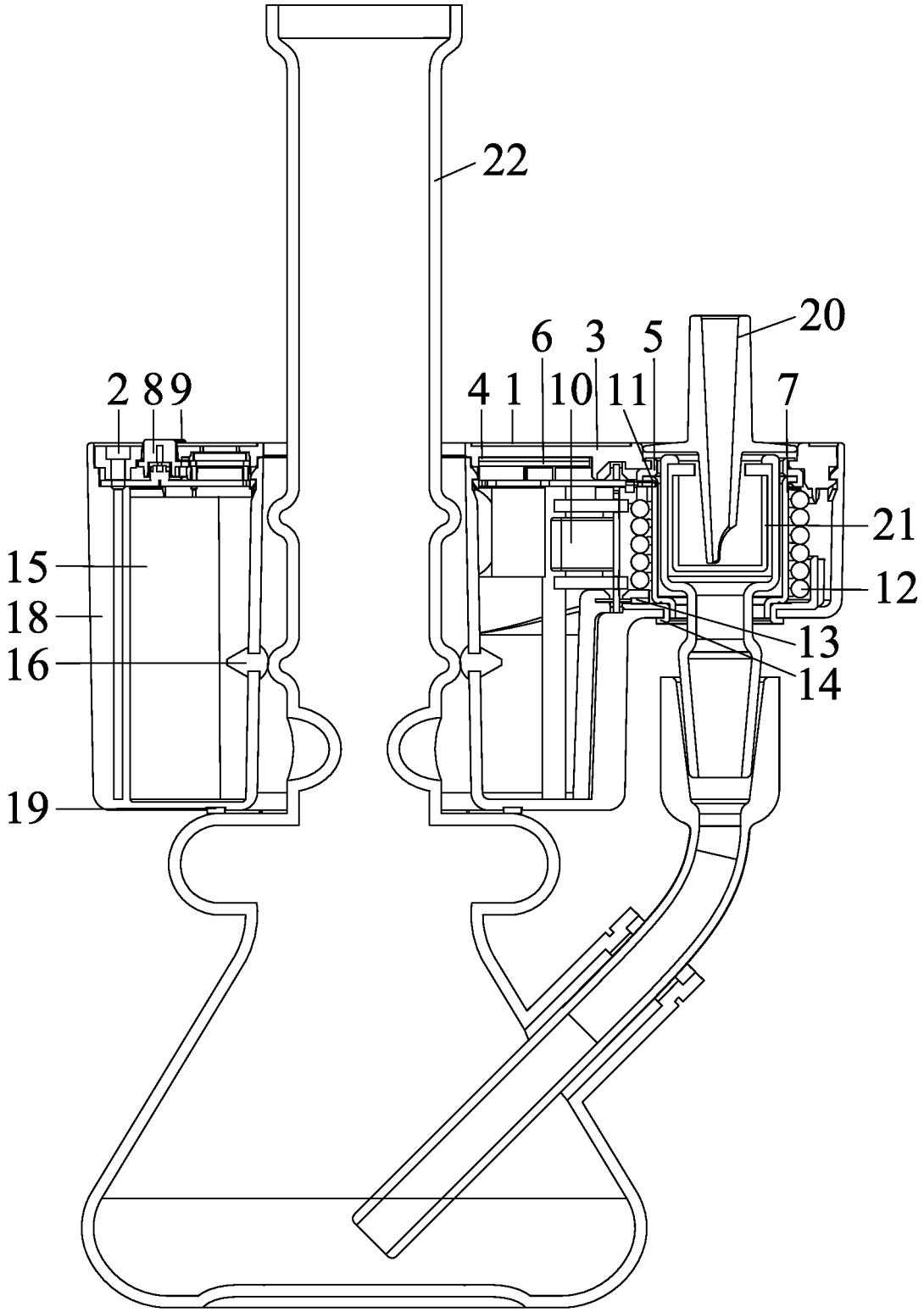
FIG. 5 is an assembly diagram of a high-frequency heating device and a hookah in accordance with one embodiment of the disclosure.

In certain embodiments, the heating device of the disclosure is in use with a hookah 22, a heating cup 21, and a nozzle 20 as shown in FIG. 4. The heating cup 21 is disposed on the hookah 22. The cavity on one side of the housing is disposed around the heating cup 22. Specifically, the through hole in the middle part of the housing is disposed around the neck of the hookah 22. The nozzle 20 is disposed on the top of the heating cup 21 for air admission. The heating cup 21 comprises an inlaid metal conductor. In the power on state, an eddy current is formed in the metal conductor in the induction magnetic field of the magnetic induction coil 12, and thus the metal conductor is heated. The heat is transferred to the heating cup 21 through heat transfer, so that the tobacco material in the heating cup 21 is heated to produce vapor or smoke. When in use, air enters the heating cup 21 via the nozzle 20 and drives the vapor or smoke resulting from the atomization of the tobacco material in the heating cup to submerge in the water in the hookah. The vapor or smoke is filtered in the water and discharged out of an exit for user's inhaling. When the air enters the heating cup 21 via the nozzle 20, the internal temperature in the heating cup varies. The temperature difference sensor 11 senses the change of temperature in the air flow and controls the variable-frequency power supply 10 to work in an automatic heating mode. In this way, it is not necessary to press the manual button 8 by hand, as long as the air flow passes and the temperature varies, the heating device can work automatically.

The following advantages are associated with the high-frequency heating device of the disclosure:

1. The housing of the high-frequency heating device comprises a central through hole and an enclosure surrounding the central through hole. When in use, the neck of a hookah passes through the central through hole. This simplifies the combined use of the high-frequency heating device and the hookah, and the hookah does not need to be held by hand.

2. The temperature difference sensor senses the change of temperature in the air flow and controls the variable-frequency power supply to work in an automatic heating mode. However, conventional heating devices have only one work mode, and when in use, the manual button must be pressed by fingers.

3. The heating device is detachable from the hookah, so it is easy to carry and clean.

It will be obvious to those skilled in the art that changes and modifications may be made, and therefore, the aim in the appended claims is to cover all such changes and modifications.

What is claimed is:

1. A high-frequency heating device, comprising a housing, a thermal insulation sleeve, a magnetic induction coil, a variable-frequency power supply, and a battery;

wherein the housing comprises a central through hole and an enclosure surrounding the central through hole;

the housing further comprises a first lateral portion and a second lateral portion opposite the first lateral portion; the central through hole is disposed between the first lateral portion and the second lateral portion;

the first lateral portion comprises a first cavity and the magnetic induction coil is disposed in the first cavity; the thermal insulation sleeve is fixed in the magnetic induction coil; when in use, a neck of a hookah passes through the central through hole, and a heating cup containing tobacco material is disposed around the neck; the enclosure is disposed around the heating cup so that the high-frequency heating device is able to heat the tobacco material in the heating cup;

the variable-frequency power supply is disposed in the housing;

the second lateral portion comprises a second cavity; the battery is disposed in the second cavity; and an output end of the battery is connected to an input end of the variable-frequency power supply; an output end of the variable-frequency power supply is connected to the magnetic induction coil; when in use, an alternating current output by the variable-frequency power supply flows through the magnetic induction coil whereby an induced magnetic field is produced.

2. The high-frequency heating device of claim 1, further comprising a temperature difference sensor, wherein the temperature difference sensor is connected to the variable-frequency power supply and is disposed in an opening of the thermal insulation sleeve to sense a temperature change of an air flow, so as to control the variable-frequency power supply whether or not to enter an automatic heating working mode.

3. The high-frequency heating device of claim 2, further comprising a thermistor, wherein the thermistor is connected to the variable-frequency power supply and is located in an inner wall of the thermal insulation sleeve for over temperature protection; when a working temperature reaches a maximum of 600° F., no current is output from the variable-frequency power supply, and the high-frequency heating device stops working.

4. The high-frequency heating device of claim 3, further comprising a sliding button and a manual button, wherein the manual button is connected to a second contact terminal on the variable-frequency power supply to switch on the power supply to heat the tobacco material; the sliding button is connected to a third contact terminal on the variable-frequency power supply and is exposed out from a side wall of the housing; when in use, the working mode of the high-frequency heating device is switchable by pressing the sliding button so as to heat different tobacco materials.

5. The high-frequency heating device of claim 1, wherein when the high-frequency heating device is in use with the heating cup and the hookah, the heating cup is disposed around the neck of the hookah; a diameter of the heating cup is corresponding to that of the central through hole of the housing, so that the thermal insulation sleeve is disposed around the heading cup.

6. The high-frequency heating device of claim 1, wherein the heating cup comprises glass and a metal inlaid in the glass, and has a frosted surface.

7. The high-frequency heating device of claim 5, wherein the hookah further comprises a nozzle disposed on a top of the heating cup for air admission.

8. The high-frequency heating device of claim 7, wherein in a power on state, the heating cup is heated in an induction magnetic field formed by the magnetic induction coil, so that the tobacco material in the heating cup is heated to produce vapor or smoke; air enters the heating cup via the nozzle, and an internal temperature in the heating cup varies; the temperature difference sensor senses a change of temperature in the air flow and controls the variable-frequency power supply to work in an automatic heating mode; the air drives the vapor or smoke in the heating cup to submerge in water in the hookah, and the vapor or smoke is filtered in the water and discharged out of an exit for user's inhaling.

* * * * *